United States Patent [19]

Bernard

[11] Patent Number: 4,847,583

[45] Date of Patent: Jul. 11, 1989

[54] TOROIDAL TRANSFORMER WITH INTEGRATED SELF-INDUCTANCE DEVICE

[75] Inventor: Chappel Bernard, Albertville, France

[73] Assignee: Societe Pour L'Application de L'Optique et de L'Electronique a La Recherche et a L'Automatisation Optelec, societe anonyme, France

[21] Appl. No.: 211,465

[22] Filed: Jun. 24, 1988

[30] Foreign Application Priority Data

Jun. 26, 1987 [FR] France ..... 8709507

[51] Int. Cl.[4] ..... H01F 15/04; H01F 17/06; H01F 27/30

[52] U.S. Cl. ..... 336/84 C; 336/178; 336/198; 336/212; 336/229

[58] Field of Search ..... 336/84 C, 84 R, 84 M, 336/212, 229, 178, 165, 155, 60, 196, 198, 134

[56] References Cited

U.S. PATENT DOCUMENTS

| | | | |
|---|---|---|---|
| 1,548,388 | 8/1925 | Sharkelton | 336/229 X |
| 2,753,513 | 7/1956 | Sola | 336/155 X |
| 4,509,032 | 4/1985 | Post | 336/84 M |

FOREIGN PATENT DOCUMENTS

| | | | |
|---|---|---|---|
| 2945040 | 5/1980 | Fed. Rep. of Germany | 336/212 |
| 3324078 | 1/1985 | Fed. Rep. of Germany | 336/229 |
| 647751 | 2/1979 | U.S.S.R. | 336/229 |
| 653628 | 3/1979 | U.S.S.R. | 336/229 |

*Primary Examiner*—Thomas J. Kozma
*Attorney, Agent, or Firm*—Ratner & Prestia

[57] ABSTRACT

The invention provides a toroidal transformer with integrated self inductance device, comprising a closed main annular magnetic circuit on which an inner electric winding is coiled. A magnetic core, in the form of an open annular sector, is held in position at the periphery of the inner winding by peripheral bars. The assembly is covered by the outer electric winding. The magnetic core determines the value of the self inductance of the transformer.

13 Claims, 8 Drawing Sheets

TOROIDAL TRANSFORMER WITH INTEGRATED SELF-INDUCTANCE DEVICE

BACKGROUND OF THE INVENTION

The present invention relates to electric transformers for transmitting electric power and more particularly to transformers one at least of the windings of which has integrated self-inductance.

Integrated self-inductance transformers are generally formed around a conventional magnetic circuit with two or three parallel columns connected together by two end crosspieces, the primary and secondary windings being coiled about the central column. The integrated self-inductance is obtained by providing an open auxiliary magnetic circuit surrounded by only one of the primary and secondary windings. The secondary magnetic circuit, unsaturable under normal conditions of use, limits for example the short circuit current of the transformer.

Such transformers with conventional magnetic circuit have in particular the drawback of being relatively bulky and heavy : the configuration of the magnetic circuit causes electromagnetic radiation harmful to the neighborhood of the transformer, which radiation is further increased very appreciably when a secondary magnetic core is incorporated for obtaining the self-inductance.

Electric transformers are further known, generally called toroidal transformers, whose magnetic core has a closed annular form. The primary and secondary windings of such a transformer are generally coiled one on the other. It is known that such a transformer is, for equal power, less bulky and less heavy than a conventional magnetic-circuit transformer with two or three columns.

Such a toroidal transformer is however more difficult to construct, and in particular more difficult to wind, since the magnetic circuit is already closed during winding and the electric winding wire must pass as many times through the central chimney of the magnetic circuit as there are turns to form the coil.

Attempts have been made to construct toroidal transformers with integrated self-inductance, by separating the primary and secondary windings from each other, i.e. by coiling a first winding on a first circular sector of the magnetic circuit and coiling the other winding on a second circular sector of the magnetic circuit, different from the first sector.

Such a solution has not proved usable on an industrial scale, for it makes the electric windings even more difficult to coil on the torus and the coiling cannot be readily automated. Such an arrangement further leads to increasing the volumes, the copper sections forming the windings and the heating of the transformer; the self-inductance thus obtained is difficult to control quantitatively when it is desired to design a transformer having new characteristics. It has been further discovered that such a structure leads to increasing substantially the electromagnetic radiation in the vicinity of the transformer.

SUMMARY OF THE INVENTION

The purpose of the present invention is in particular to avoid the drawbacks of known transformers, by providing a new toroidal transformer structure with integrated selfinductance which is particularly simple and easy to coil and to assemble.

According to another object of the invention, this new structure makes it possible to design a transformer with integrated self-inductance around which the electromagnetic radiation is relatively much smaller.

According to another object of the invention, the structure makes it possible to adjust and control at will the value of the integrated self-inductance, by a simple mechanical displacement of some structural parts; it is thus much easier to design and construct transformers having new electric characteristics and the characteristics may be obtained in a precise way.

According to another object of the invention, the new structure is relatively inexpensive, for the magnetic circuit is formed of elements whose shapes are simple and easy to obtain, and which can be assembled relatively speedily and only requires a small labor force. The structure is further particularly well adapted to providing very complete automation of the assembly.

Another important problem which the present invention solves is the thermal heating appearing in toroidal circuit transformers. For equal power, such heating is relatively greater than in conventional three column magnetic circuit transformers, for in these conventional transformers, the heat exchange surfaces are appreciably greater. In the case of a toroidal transformer, the inner electric winding is completely imprisoned by the electric insulating layers and by the outer electric winding, so that the heat exchanges are considerably reduced.

For that the present invention provides particularly advantageous embodiments, in which the electric insulating means have a shape and structure allowing heat transfer from the inner electric winding to the outer and appreciably increasing the natural cooling of the windings. Consequently, such a structure makes it possible to reduce the section of the conductors, whence a substantial saving in the weight of the copper, a very expensive commodity.

Another object of the invention is to reduce the average length of the turns forming the electric windings of the transformer, without adversely affecting the electric insulation or the cross section of the magnetic circuit.

The invention also makes it possible to coil toroidal transformer with a flat wire of large cross-section. Because of the toroidal shape with rectangular cross-section of the magnetic circuit, the turns are disposed radially. They are therefore jointing in the chimney of the torus and are spaced apart on the external periphery, because of the difference of the developed lengths of the external and internal diameters of the torus. After coiling a first layer of jointing turns in the chimney of the torus, the next layer tends to be superimposed on the preceding one in the bore, but to be inserted between the turns of the first layer on the external periphery. In an intermediate zone, the external turns bear on the internal turns at a point of their edge, so that with the contact taking place over a very small area, it forms a very high pressure bearing zone likely to damage the electric insulation. The invention provides means for avoiding this concentration of tractive forces on two pin-point bearing points on each turn.

Another object of the present invention is to provide correct maintenance of the auxiliary magnetic circuit forming the integrated self-inductance, so as to avoid the vibrations of plates generating harmful noise.

Another important object of the invention, is to considerably reduce the number of parts required for electrically insulating the windings. The result is a reduction in the cost of the raw materials and especially a reduction of the cost of the labor required for assembly.

To attain these objects as well as others, the toroidal transformer of the present invention comprises a main annular closed magnetic circuit, means for electrically insulating the outer surface of the magnetic circuit, an inner electric winding coiled on the insulation of the main magnetic circuit, an intermediate electric insulation surrounding the inner electric winding, and an outer electric winding coiled about the intermediate electric insulation. The transformer of the invention further comprises at least one magnetic core having at least one open annular sector defined by an air-gap and disposed parallel to the main annular magnetic circuit between the inner electric winding and the outer electric winding. The magnetic core defines, by its structure and its position, the value of the self-inductance of the outer electric winding.

In another advantageous embodiment, the magnetic core has at least one annular sector disposed along the periphery of the inner winding. Alternately or complementarily, the magnetic core has a least one annular sector disposed in the central bore of the inner winding.

In a particular embodiment, the core has two successive annular sectors disposed along the periphery of the inner winding. That facilitates insertion of the magnetic core and the adjustment of the inductance by positioning the successive annular sectors.

In a first embodiment, the electric insulating means comprise an upper ring and a lower ring, made from an insulating and rigid material whose external contours are connected together by axial bars forming a support for the peripheral magnetic core. The peripheral magnetic core is advantageously formed of a stack of sheets bent on the periphery defined by the axial bars and on which it is held in position by peripheral insulating taping. This structure considerably facilitates assembly of the transformer, namely the assembly of its components, and the adjustment of the self-inductance may be provided by sliding the sheets in the housing defined between the axial bars and the peripheral taping.

The upper and lower rings advantageously have a circular inner contour of a diameter less than the inner diameter of the main annular magnetic circuit; the rings thus form a support on which the outer winding may be coiled. The rings thus separate the two windings, increase the heat exchange surface, participate in the electric insulation and define a rigid support allowing the coiling of the outer winding to be automated.

In a preferred embodiment, adapted to a form of toroidal magnetic circuit with substantially rectangular cross-section, the electric insulating means include an upper electrically insulating toroidal cap and a lower electrically insulating toroidal cap; each toroidal cap is limited by an outer circular contour of a diameter only a little greater than the outer diameter of the ring formed by the inner electric winding and being defined by an inner circular contour of a diameter only a little less than the inner diameter of the ring formed by the inner electric winding; the respective contours of the upper cap and the lower cap facing each other are separated by a space promoting the transfer of heat energy. This embodiment substantially increases the heat energy transfer from the inner winding to the outer and provides a substantial saving in space in the central bore of the circuit.

The outer faces of the cap edges advantageously have a rounded cross-section. This arrangement substantially reduces the length of copper required for forming the electric winding and improves the evenness of coiling.

The external contour of each of the caps may advantageously comprise an annular groove facing the annular groove of the other cap; the magnetic core comprising a stack of bent metal sheets, is held in position by the caps, the edges of the magnetic core being nipped respectively in the upper cap groove and in the lower cap groove. If required the caps themselves hold in position electrostatic screens for the transformer.

BRIEF DESCRIPTION OF THE DRAWINGS

Other objects, features and advantages of the present invention will be clear from the following description of particular embodiments, with reference to the accompanying figures in which.

DESCRIPTION OF THE PREFERRED EMBODIMENT

Figure 1:
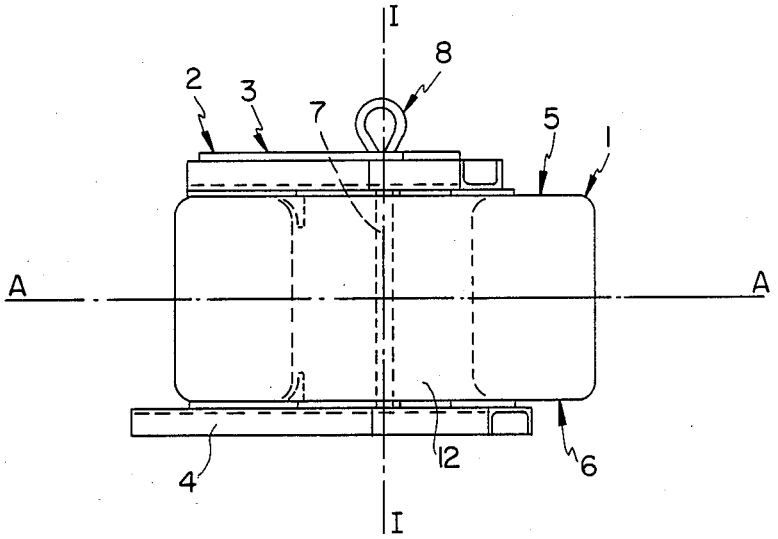
FIG. 1 shows a general side view of a transformer of the present invention.
Figure 2:
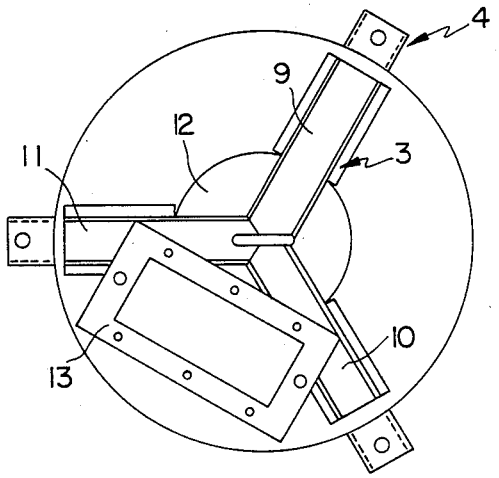
FIG. 2 shows a top view of the transformer of FIG. 1.

The transformer of the present invention as shown in FIGS. 1 and 2 has a general annular external shape. The body 1 of the transformer is a ring with axis I—I and of substantially rectangular cross-section. The body is secured to a fixing and transport assembly 2 comprising a first end element 3 and a second end element 4 applied respectively on the first side 5 and on the second side 6 of body 1. The end elements 3 and 4 are connected together by a central connecting column 7 on the top of which is fitted a carrying loop 8.

In the embodiment shown in FIG. 2, the end elements such as the first element 3 comprise three divergent arms arranged in a star. Thus, the first end element 3 has arms 9, 10 and 11. The arms are joined together at the center, in the axis I—I of the transformer, and are fixed to the central connecting column 7. The central connecting column 7 passes through the central bore 12 of body 1. A support plate 13, fast with the first end element 3, supports the electric connection terminals of the transformer. The divergent arms have their internal faces shaped so as to mate with the shape of the first side 5 or of the second side 6 of body 1, in the vicinity of the central bore 12 of body 1, thus providing lateral solidity between body 1 and the fixing and transport assembly 2.

Figure 3:
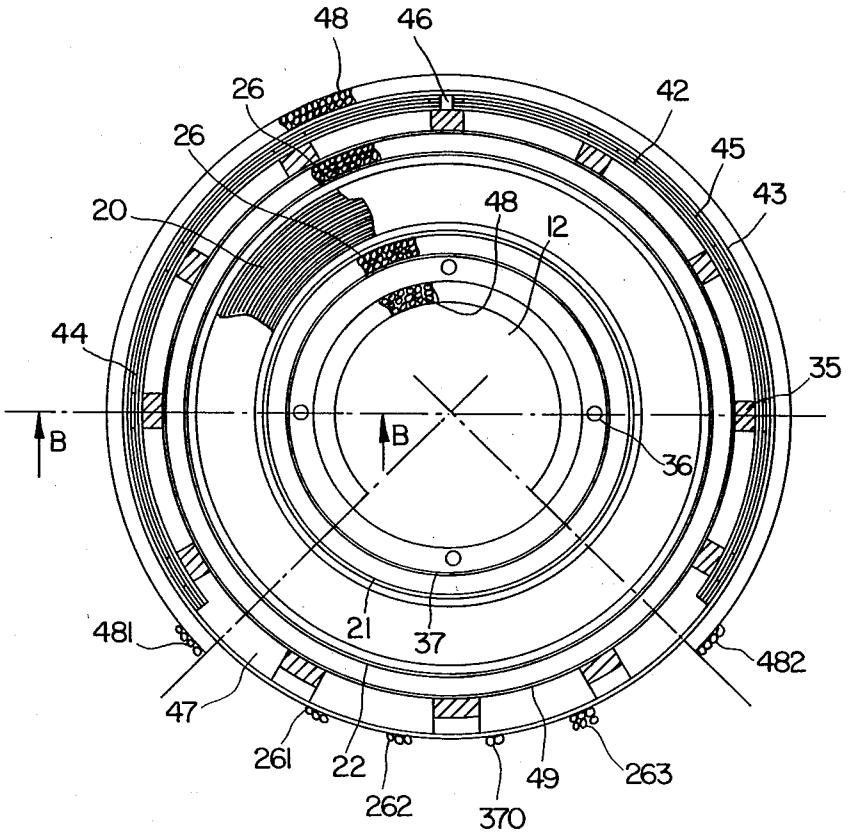
FIG. 3 is a top view in section through plane A—A of FIG. 1 in a first embodiment.
Figure 4:
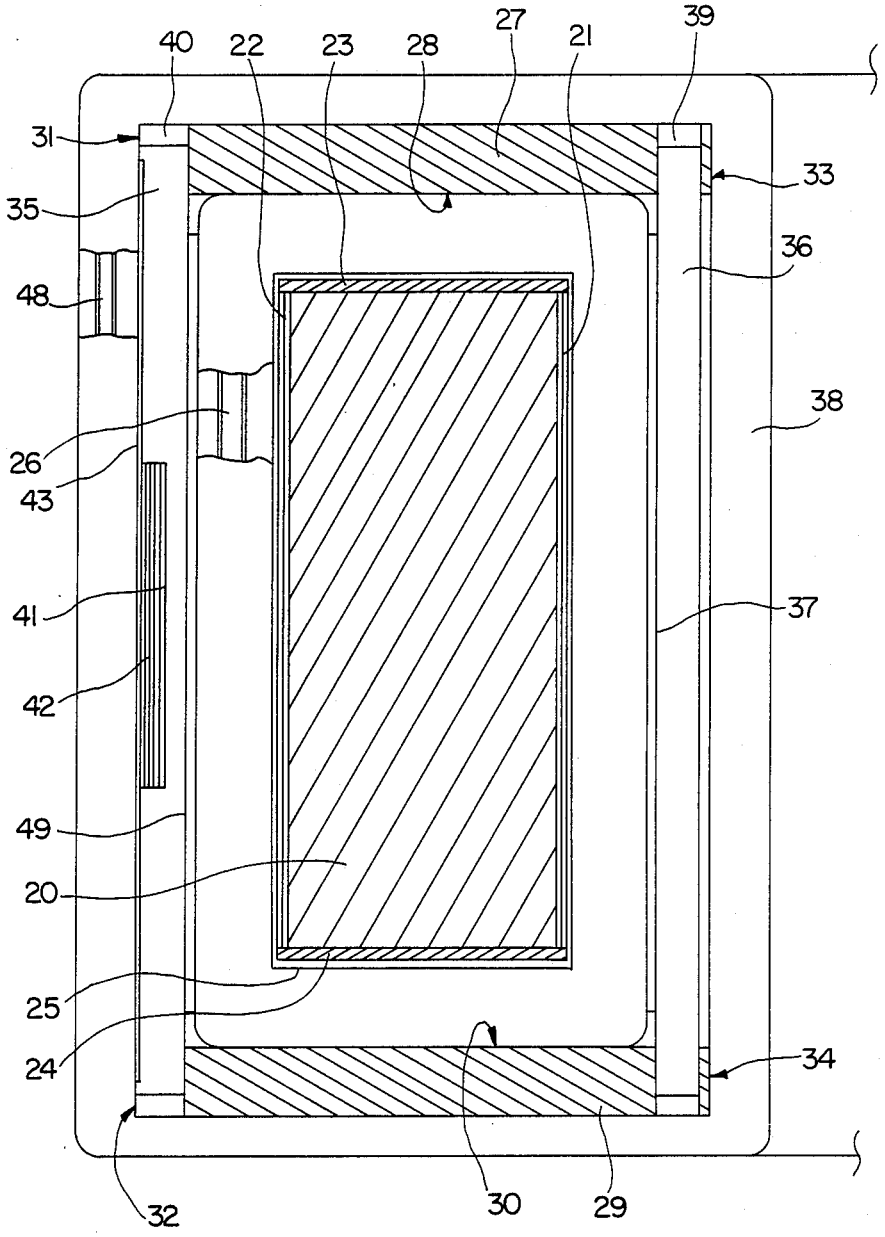
FIG. 4 is a half side view in section through plane B—B and on a larger scale of FIG. 3.

FIGS. 3 and 4 illustrate the internal construction of transformer body 1 in a first embodiment of the invention. For a clearer understanding of the drawings, the metal sheets of the magnetic circuit have been shown only partially; the same goes for the conductors forming the transformer windings, which conductors are shown in cross-section in FIG. 3 and in longitudinal section in FIG. 4.

In the embodiment shown in these figures, the transformer comprises a main magnetic circuit 20 in the form of a closed circular ring with rectangular cross-section. The magnetic circuit is formed in a way known per se by a circular metal sheet winding.

The magnetic circuit 20 is insulated electrically over the whole of its surface. The electric insulation may advantageously be provided by an inner band 21 covering the wall of the inner bore of the magnetic circuit, an outer band 22 covering the peripheral wall of the magnetic circuit, an upper flange 23 covering the upper side of the magnetic circuit and a lower band 24 covering the lower side of the magnetic circuit. The insulation may be completed by taping 25. The taping holding in position simultaneously flanges 23 and 24 and bands 21 and 22 on the magnetic circuit, so as to define a sub-assembly which can be handled and capable of receiving a winding provided by automatic mechanical means.

The sub-assembly thus formed receives, by coiling in a known way, a first electric winding called inner winding 26, formed of a suitable number of turns of electric wire coiled about the magnetic circuit 20.

A flat upper ring 27 is applied against the upper side 28 of the inner electric winding 26 and a flat lower ring 29 is applied against the lower side 30 of the inner electric winding 26. Rings 27 and 29 are made from an electrically insulating material having sufficient rigidity for supporting and holding the outer electric winding in position without excessive deformation. Preferably, the upper 27 and lower 29 rings have identical external contours 31 and 32, and internal contours 33 and 34 which are also identical, the rings being both centered on the axis I—I of the transformer. The upper 27 and lower 29 rings are connected together, in the vicinity of their external contours 31 and 32, by axial bars 35 and, in the vicinity of their internal contours 33 and 34, by axial columns 36. In the embodiment shown, the transformer comprises four axial columns such as column 36, spaced apart evenly along the periphery of the central chimney of the inner electric winding 26. In one embodiment, columns 36 may bear against the inner wall of the inner electric winding 26: in another embodiment, an electrostatic screen 37 may be inserted between column 36 and the inner wall of the inner electric winding 26, as shown in FIG. 4. The internal contours 33 and 34 have a circular shape of a diameter less than the inner diameter of the ring formed by the inner electric winding 26, so as to define two surfaces against which the conductors forming the outer electric winding 38 come to bear and are curved.

Similarly, the external contours 31 and 32 form a bearing surface which is circular and wider than the inner electric winding 26. The rings form a support on which the outer electric winding 38 is coiled and participate in the electric insulation of the windings with respect to each other.

The upper 27 and lower 29 rings are made from an electrically insulating and mechanically rigid material. Columns 36 have a circular cross-section, and their ends are inserted in axial holes 39 of corresponding cross-section in the rings. The bars 35 have a rectangular cross-section and their ends are engaged in radial notches 40 of corresponding cross-section in the rings. The bars have an outer notch 41, of a length substantially equal to half the height of the magnetic circuit 20, and of a depth sufficient for receiving the magnetic core 42. In the embodiment shown, the transformer comprises twelve axial bars such as bar 35, spaced apart evenly at the periphery of the ring formed by the inner electric winding 26. In one embodiment, the bars may bear against the inner electric winding. In the embodiment shown, an electrostatic screen 49 is inserted between bars 35 and the inner electric winding 26.

The magnetic core 42 is formed of a stack of magnetic metal sheets, of rectangular shape, bent and applied radially from the outside in the notches 41 of bars 35. For that, notches 41 have a length slightly greater than the height of the magnetic core. After application, the metal sheets of the magnetic core 42 are held in position in the notches by a peripheral tape 43 insulating and holding the magnetic core 42 in position.

In the invention, the magnetic core 42 has an open profile in the form of an annular sector, substantially parallel to the main magnetic circuit 20 and defined by an air-gap. In the embodiment shown in FIG. 3, the magnetic core 42 is formed of a successive first annular sector 44 and a second annular sector 45 disposed along the periphery of the inner electric winding 26. The ends of the two periphery of annular sectors 44 and 45 are separated on one side by a first air-gap 46 of small thickness and are separated on the other side by a second much larger air-gap 47. Air-gap 47, shown in FIG. 3, occupies a little more than a quarter of the circumference. It will be appreciated that the magnetic metal sheets forming the first sector 44 and/or the second sector 45 may be slid, at the periphery of bars 35, for adjusting the value of the self-inductance of the transformer.

Bars 35 and columns 36 are secured to the upper 27 and lower 29 rings, for example by bonding or force fitting, so that the assembly forms a one piece sub-assembly able to be coiled by automatic mechanical means for receiving the outer electric winding. Thus, the outer electric winding 48 forms the outer layer of the transformer body. In the embodiment shown, the outer winding 48 covers the magnetic core 42, the inner winding and a part of the zone of the second air-gap 47.

In other embodiments, an outer electric winding 48 may be provided which covers the whole of the magnetic circuit and the inner electric winding.

The magnetic core 42, in the embodiment shown in FIG. 4, has a height equal to about half the height of the magnetic circuit 20 and is disposed at mid height of the main magnetic circuit 20. It will be readily appreciated that in accordance with the invention, the magnetic core 42 is disposed between the inner electric winding 26 and the outer electric winding 48. This magnetic core 42 determines the value of the self-inductance presented by the outer electric winding 48. The transformer of the present invention may in particular be used by choosing the inner electric winding as secondary winding and the outer electric winding 48 as primary winding, so that the transformer is then a transformer whose primary has self-inductance.

In FIG. 3, references 481 and 482 designate the outputs of the outer electric winding 48. This winding is formed of four parallel coiled strands. References 261 and 262 designate the ends of the inner electric winding 26 and reference 263 designates the middle point thereof. This winding is formed of three parallel coiled strands. Reference 370 designates the outputs of conductors for grounding the screens 37 and 49.

Different arrangements of the magnetic core 42 may be envisaged, without departing from the scope of the present invention. Thus, in a second embodiment, the magnetic core 42 may be formed as an annular sector disposed in the central chimney of the inner electric winding 26.

In a third embodiment, the magnetic core 42 may be formed as an annular sector disposed on one of the sides 28 or 29 of the inner electric winding 26.

The magnetic core 42 may also be formed of several parts, some parts being disposed on sides 28 and 30, some other elements being disposed on the periphery or inside the chimney.

FIGS. 8 to 11 illustrate the internal construction of the transformer body 1 in a second embodiment of the present invention.

The main magnetic circuit 20 of this embodiment is the same as that of the embodiment shown in FIGS. 3 and 4, namely a closed circular ring with rectangular cross-section formed of a circular metal sheet winding. The magnetic circuit 20 is electrically insulated over the whole of its surface. In this embodiment, the electric insulating means for the magnetic circuit comprise an upper magnetic circuit insulating toroidal cap 50, a lower magnetic circuit insulating cap 51, each covering respectively the upper face and the lower face of the magnetic circuit 20 and a part of the external and internal side faces of the magnetic circuit, caps 50 and 51 being connected together by an external cylindrical electric insulation 52 and an internal cylindrical electric insulation 53. The upper 50 and the lower 51 magnetic circuit insulating caps have, on their external faces, an external rounded edge 54 and an internal rounded edge 55.

Figure 5:
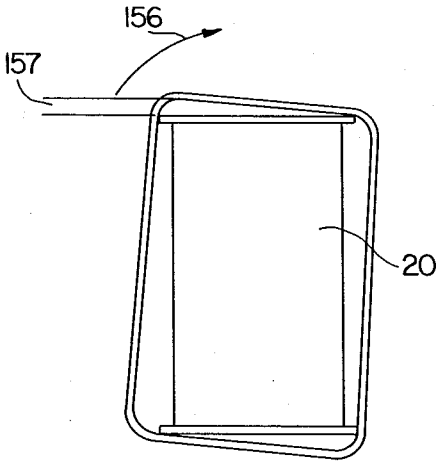
FIG. 5 illustrates the drawbacks of coiling a large diameter wire on a circuit with rectangular cross-section.
Figure 6:
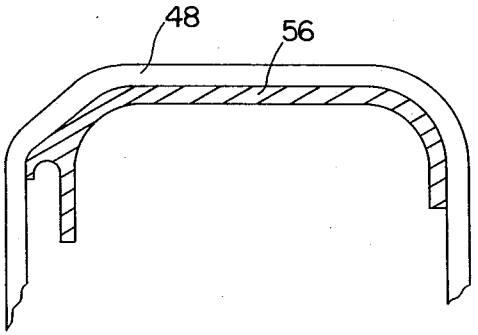
FIG. 6 illustrates the advantage of coiling a large diameter wire on a circuit whose corners are rounded.

The advantage of the rounded edges 54 and 55 is explained with reference to FIGS. 5 and 6; when the electric conductor is coiled on the toroidal magnetic circuit, and more particularly when the electric insulating conductor has a relatively large cross-section, it is not possible to bend the conductor at right angles when passing over each edge. Thus, in FIG. 5, when the magnetic circuit has sharp edges, the electric insulating conductor, wound about the magnetic circuit 20 in the direction of arrow 156, forms rounded corners, each curve beginning on passing over the corner of the magnetic circuit, and ending spaced away from the magnetic circuit, thus defining at each corner a clearance such as clearance 157. With a conductor whose thickness is about 2 mm such a clearance may exceed 3 mm. The result is that the electric winding occupies an appreciably larger cross-section than the cross-section of the magnetic circuit and this cross-section is offset with respect to the cross-section of the magnetic circuit, as shown in FIG. 5. Other than the loss occasioned by the increase in volume which results, difficulties in coiling follow and the coiling generally lacks regularity.

On the other hand, by providing rounded edges such as edges 54 and 55, the electric insulating conductor takes on perfectly the shape of the edge at each passage and is thus correctly applied on the insulator, each of its branches being parallel to the corresponding face of the magnetic circuit. It might be thought that the fact of providing rounded edges 54 and 55 would tend to increase the apparent section of the assembly formed by the magnetic circuit and its external insulator. In actual fact, and surprisingly, it has been discovered that this arrangement tends on the contrary to reduce the length of the conductor turn surrounding the magnetic circuit, resulting in a saving of copper forming the conductor.

Partial taping may fix the insulators 50, 51, 52 and 53 around the magnetic circuit. The sub-assembly thus formed then receives, by coiling in a way known per se, the first inner electric winding 26. In the embodiment shown, the inner electric winding 26 is formed of a suitable number of turns of flat electric insulating conductor with rectangular crosssection. A three layer winding has been shown, a first layer 260 formed of radial turns which are jointing in the central chimney 12 of the circuit and which are spaced apart from each other on the lateral external peripheral face of the circuit; this first layer 260 is covered by a second layer 261, shown partially in FIG. 9, formed of radial turns which are also jointing in the central chimney 12, itself having thereover a third layer 262 of the same structure, which covers it.

An upper toroidal cap 56 is fitted against the upper side 28 of the inner electric winding 26 and a lower toroidal cap 57 is fitted against the lower side 30 of the inner electric winding 26. The upper 56 and lower 57 toroidal caps are made from an electrically insulating material having a certain flexibility. Preferably, the upper 56 and lower 57 caps are identical. They have respectively circular external contours 58 and 59 of a diameter only a little greater than the external diameter of the ring formed by the inner electric winding 26. Caps 56 and 57 are defined by a circular internal contour, respectively 60 and 61, of a diameter only a little less than the inner diameter of the ring formed by the inner electric winding 26. The external contours 58 and 59 of the two caps 56 and 57 are separated from each other by a space 62 promoting the transfer of heat energy from the inner winding 26 to the outer. Similarly, contours 60 and 61 are separated from each other by a space 63 promoting the passage of heat energy from the inner winding 26 to the central chimney 12.

The upper 56 and lower 57 caps are formed so as to be applied with a small clearance on the inner winding 26. After positioning thereof, they may be held in position by any means, for example by a few turns of tape distributed in two or three zones of the periphery of the circuit.

Each cap 56, 57 has an inner flange 64 partially covering the inner cylindrical face of the inner electric winding 26 and an external flange 65 partially covering the external lateral cylindrical face of the inner electric winding 26. These flanges ensure fitting of caps 56 and 57 on the inner winding and their thicknes defines the thickness of the air-gap separating the inner electric winding 26 from the outer electric winding or magnetic shunt.

Figure 11:
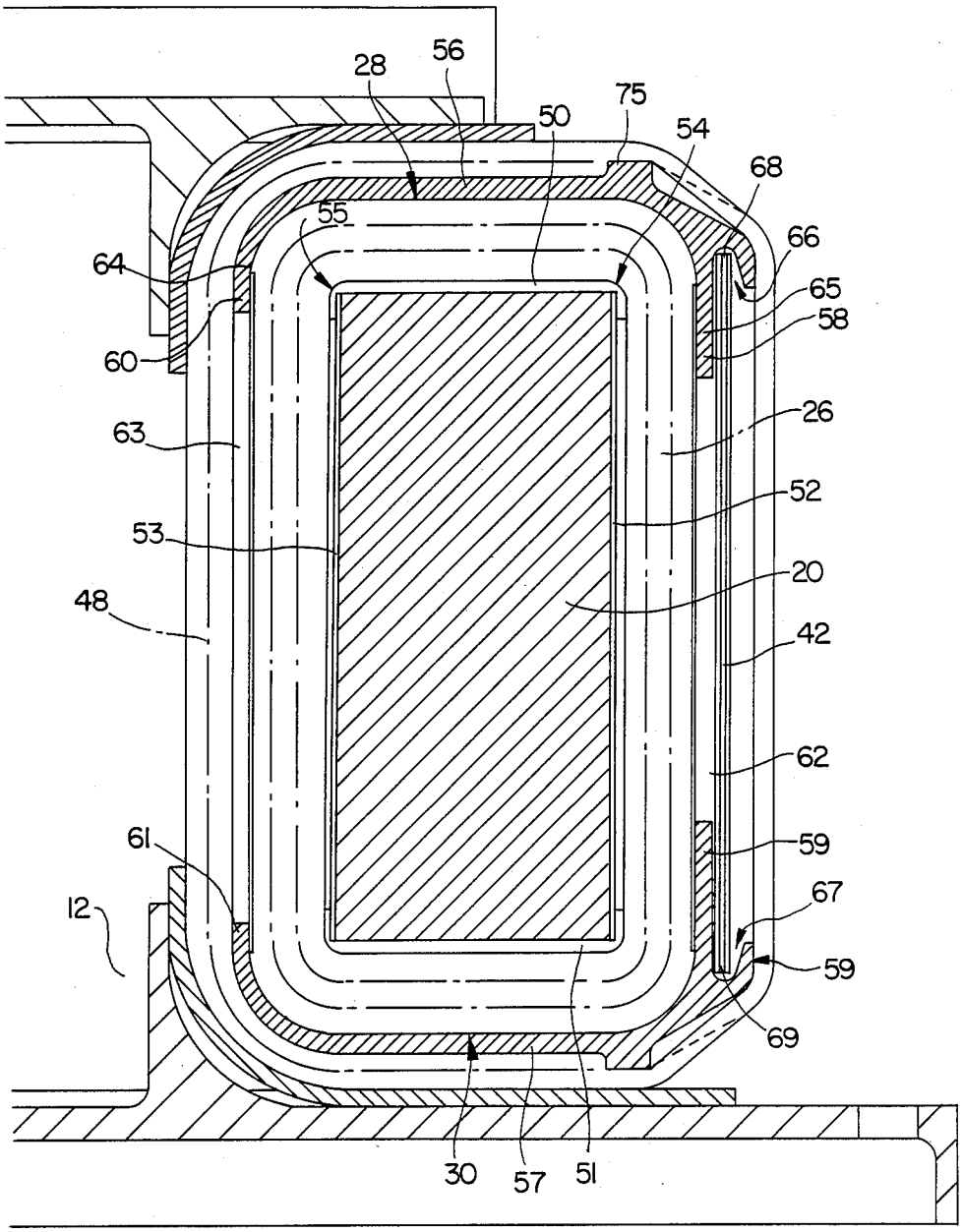
FIG. 11 is a half side view in section through plane C—C and on a larger scale of FIG. 10.

Referring to FIG. 11 it can be seen that the external contours 58 and 59 of the two caps 56 and 57 have a particular shape; thus, the external contour 58 of cap 56 comprises an annular groove 66 and the external contour 59 of cap 57 has an annular groove 67, grooves 66 and 67 facing each other as shown in the figure.

The magnetic core 42, formed of a stack of magnetic metal sheets, of rectangular shape and bent, has an upper edge 68 engaged in groove 66 and a lower edge 69 engaged in groove 67. During coiling of the outer electric winding on top of caps 56 and 57, the walls of grooves 66 and 67 tend to draw together and nip the edges of the magnetic core 42. The result is that the metal sheets are held tightly in position, avoiding noise and vibrations, and facilitating their assembly. Despite the clamping, it still remains possible to slide one of the sheets forming the magnetic core 42 for subsequent adjustment of the transformer. In this embodiment, the magnetic core 42 has an open profile, in the form of an annular sector with a single air-gap 47.

The outer electric winding 48, formed of radial turns, covers the assembly thus formed. Caps 56 and 57 form the support for the outer electric winding 48.

Figure 7:
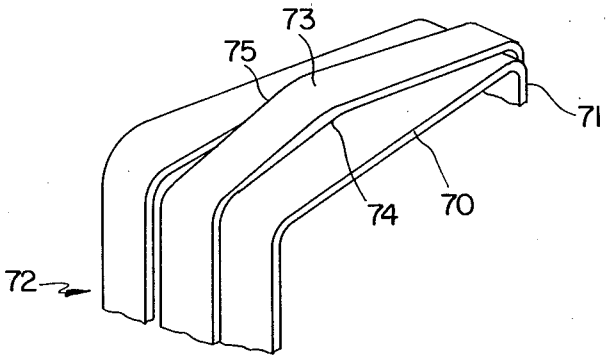
FIG. 7 illustrates the drawbacks of coiling a flat electric conductor with rectangular cross-section on a toroidal magnetic circuit.
Figure 8:
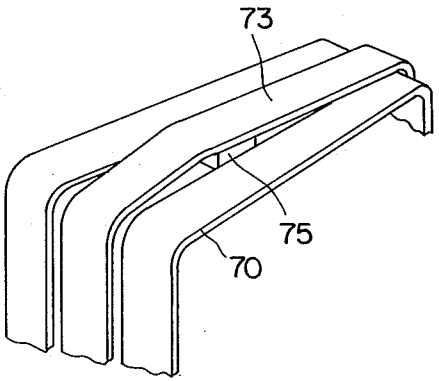
FIG. 8 illustrates on a larger scale the overlapping of the turns in accordance with the present invention.

The external faces of contours 58, 59, 60 and 61 of caps 56 and 57 advantageously have a rounded cross-section, as shown in FIG. 11. Because of this rounded section, the average turn of the outer winding 48 has a reduced length, and the coiling is more regular. The external face of caps 56 and 57 further has a feature for solving the problems related to the coiling of a flat electric conductor of large cross-section on a toroidal core. The problem which is met with is illustrated in FIGS. 7 and 8. Because the turns of a first layer 70 are jointing in zone 71 opposite the central chimney 12 of the circuit, the same turns are spaced apart in the external zone 72. When an upper layer of turns is wound above the lower layer 70, for example when conductor 73 is positioned, this conductr overlaps two conductors of the lower layer 70 in the vicinity of zone 71 but tends to insert itself between two conductors of the lower layer 70 in the vicinity of the external zone 72. Change-over from overlapping to insertio takes place in an intermediate zone, in which conductor 73 is bent and bears at two lateral points 74 and 75 on each of the conductors of the lower layer 70. These pinpoint lateral bearing points are the seat of a considerable pressure, damaging the conductor insulators.

Figure 9:
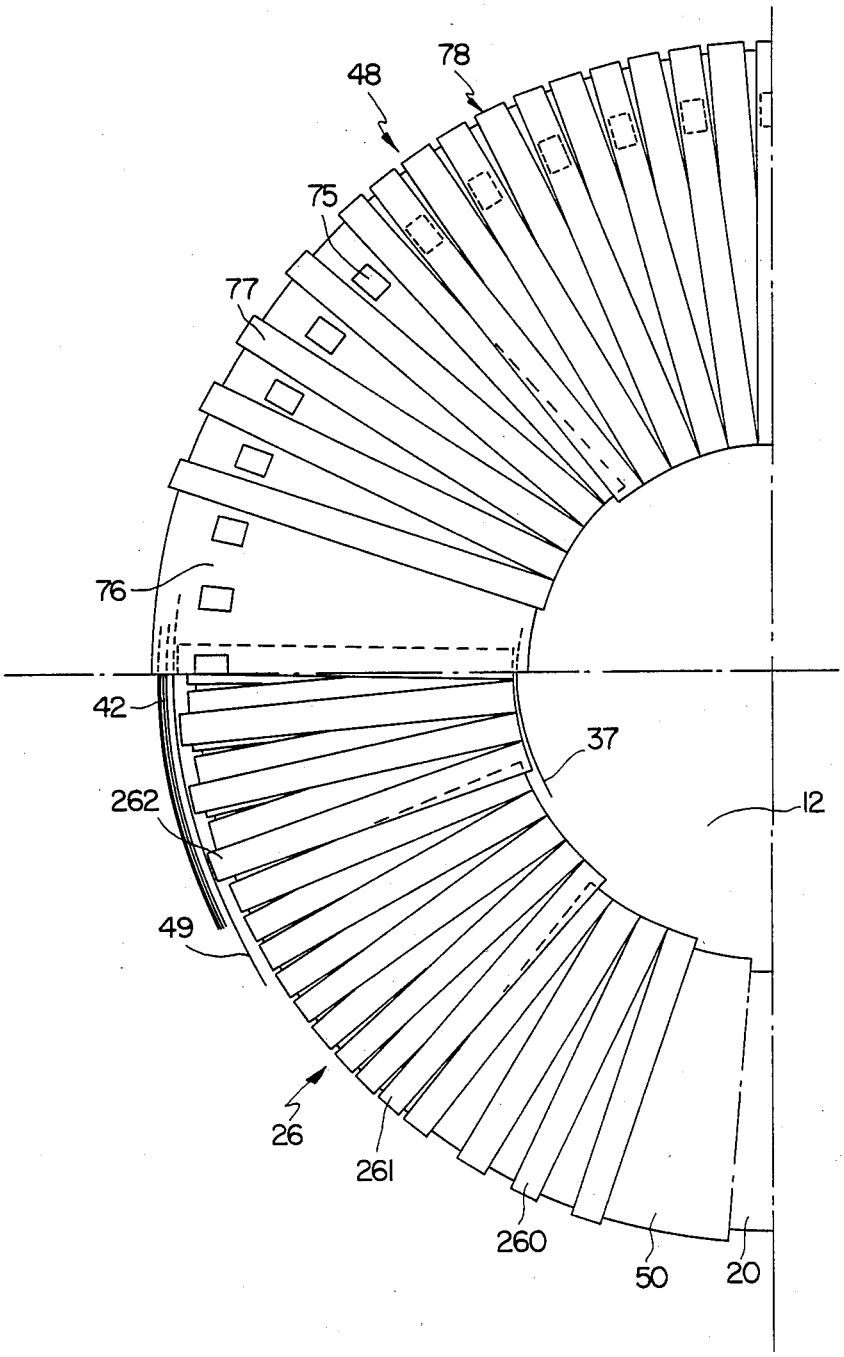
FIG. 9 is an end axial view of the toroidal transformer electric windings using a flat electric conductor with large cross-section.

To avoid this drawback, caps 56 and 57 comprise, on their flat external faces, wedges 75, distributed evenly in a circle in an intermediate zone between the internal contour and external contour of the caps. Wedges 75 have a height substantially equal to the thickness of the flat conductor, and are separated from each other by a space 76 of a width greater than the width of the flat conductor forming the winding. Thus, to form the outer winding 48, a first winding layer 77 is formed by conductor turns each engaged between two succesive wedges. A second winding layer 78 is formed by conductor turns each passing over the upper face of a wedge, as shown in FIG. 9. Thus, as can be seen in FIG. 8, wedge 75 avoids the lateral pinpoint contact between the conductors of the lower layer 70 and conductor 73 of the upper layer.

Caps 56 and 57 hold the magnetic core 42 mechanically in position. As can be seen from FIG. 9, caps 56 and 57 may also hold in position electrostatic screens 37 and 49 disposed between the primary winding and the secondary winding of the transformer.

The annular grooves 66 and 67 holding the magnetic core 42 in position may be interrupted over a part of their periphery, making it possible to handle the metal sheets of the magnetic core 42 for moving them by peripheral sliding. The sheets are accessible in the zone of air-gap 47, which zone is not entirely covered by the outer electric circuit 48. In actual fact, the outer electric circuit 48 covers the whole of the torus, except for a part of the air-gap 47.

Advantage may be taken of the presence of caps 56 and 57 for providing, in their upper or lower surface, chimneys for the passage of conductors for holding in position the end of the inner windings and letting them pass.

Figure 10:
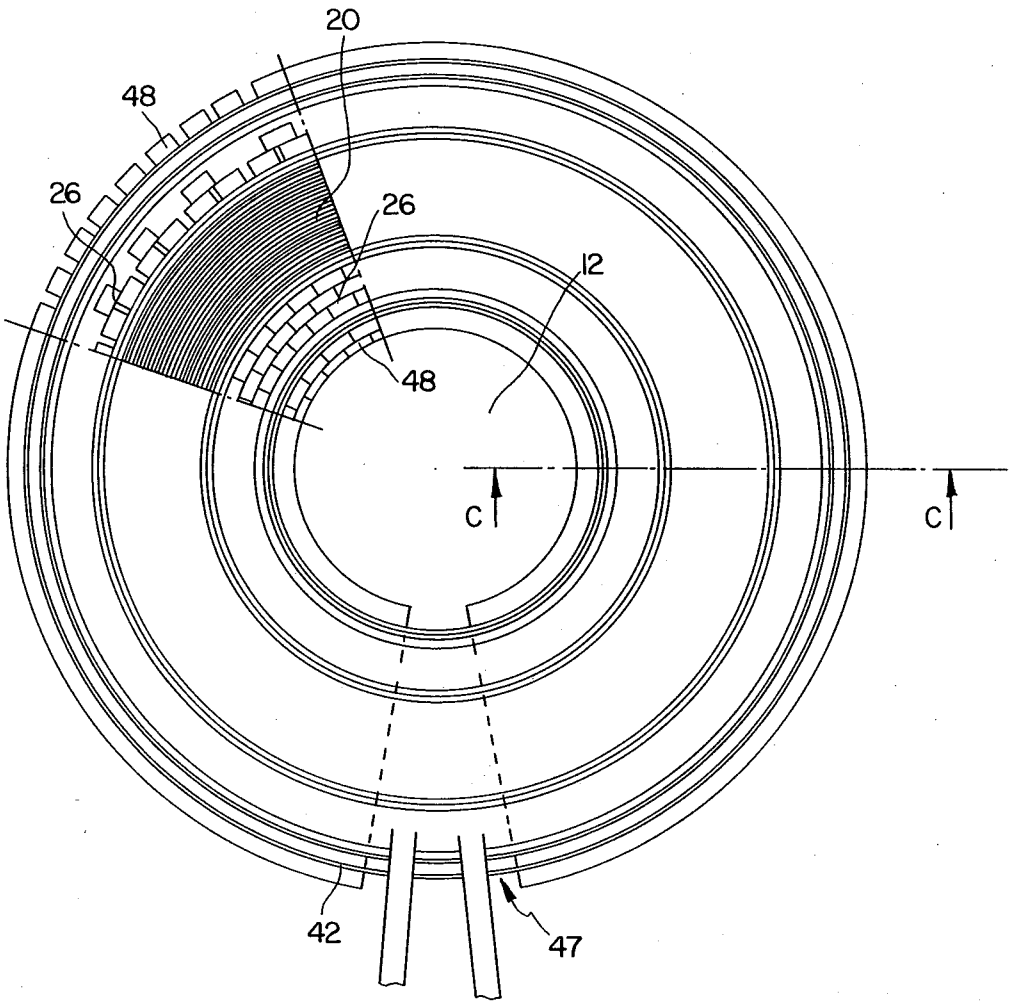
FIG. 10 is a top view in section through plane A—A of FIG. 1, in a second embodiment.

In the embodiment shown in FIGS. 9 to 11, only caps 56 and 57 are provided with wedges 75. Surprisingly, it has been discovered that the presence of these wedges 75 considerably improves the evenness of the turns of the outer winding 48. The result is substantial improvement in the reproducibility of the electric characteristics of the transformer thus obtained, so that it becomes practically pointless to adjust these electric characteristics, after assembly, by adjusting the metal sheet of the magnetic core 42.

Caps may further be used comprising wedges 75 disposed no longer between the primary winding and the secondary winding of the transformer but between successive winding layers, thus obtaining the same advantages. Wedges 75 could also be used on caps 50 and 51 of the magnetic circuit. Wedges 75 may also be advantageously used with round crosssection electric insulating conductors.

Caps 56 and 57 between electric insulating windings may advantageously be formed with apertures spaced apart over their surfaces. Such apertures not shown in the figures, promote the heat exchanges from the inner winding to the outer.

The present invention is not limited to the embodiments which have been explicitly described but it includes the different variants and generalizations thereof contained within the scope of the following claims.

What is claimed is

1. A toroidal transformer comprising:

a main annular magnetic circuit;

inner electric insulation means surrounding the main ananular magnetic circuit;

inner electric winding means including a plurality of turns of electric wire coiled around said inner electric insulation means;

an auxiliary magnetic core;

intermediate electric insulation means for electrically insulating said inner electric winding and for providing correct maintenance of said auxiliary magnetic core to avoid unwanted vibrations of said auxiliary magnetic core; said intermediate electric insulation means including: an upper rigid electrically insulating ring; a lower rigid electrically insulating ring; and means for engaging and holding said auxiliary magnetic core; and outer electric winding means including a plurality of turns of electric wire coiled on said intermediate electric insulation means around said inner electric winding means and said auxiliary magnetic core.

2. The transformer set forth in claim 1, wherein:

the upper and lower rigid electrically insulating rings of the intermediate electric insulation means have respective external contours; and said means for engaging and holding said auxiliary magnetic core includes:

a plurality of axial bars, each having first and second ends coupled to the external contours of said respective upper and lower rings, for positioning said upper and lower rings concentrically above and below said inner electric winding, respectively; and said auxiliary magnetic core includes a stack of bent metal bars configured to be positioned around a periphery of said intermediate insulation means defined by said plurality of axial bars;

wherein each of said axial bars includes an external notch having a length that is at least sufficient to receive said stack of bent metal bars.

3. The transformer set forth in claim 1, wherein each of the upper and lower rings of said intermediate insulation means have an inner contour and an outer contour, wherein the outer and inner contours of each of said upper and lower rings are respectively greater than the outer diameter and less than the inner diameter of a ring formed by said inner electric winding and wherein said upper and lower rings form a support on which said outer electric winding is coiled.

4. The transformer set forth in claim 1, wherein:

said auxiliary magnetic core includes at least one annular section and has first and second ends which define an air-gap; and said outer electric winding covers said auxiliary magnetic core and only a part of said air-gap.

5. The transformer set forth in claim 1, wherein:

said outer winding includes first and second winding layers formed by turns of a conductor around said intermediate electric insulating means;

one of the upper and lower electrically insulating rings of said intermediate electric insulating means has a relatively flat face which is delimited by an internal contour and an external contour, said one ring having a plurality of wedges distributed evenly around the face of the one ring in an intermediate zone between the internal and external contours, each of said wedges having a height substantially equal to the thickness of the conductor used for the outer winding, and said wedges being mutually separated by a space of a width greater than the width of the conductor used for the outer winding; and said first winding layer of said outer winding is formed by turns of said conductor each of which is engaged between two successive wedges and said second winding layer of said outer winding is formed by turns of said conductor each passing over a respectively different one of said plurality of wedges.

6. The transformer set forth in claim 1, wherein:

said inner electric winding forms a ring having an inner diameter and an outer diameter;

said upper and lower electrically insulating rings each have the form of a toroidal cap and are engaged concentrically on respective upper and lower faces of the ring formed by said inner electric winding each of said upper and lower toroidal caps having an inner contour and an outer contour that have diameters which are respectively less than and greater than the respective inner diameter and outer diameter of the ring formed by said inner electric winding, wherein said outer contour includes an annular groove;

wherein said upper torodial cap is separated from said lower torodial cap by a space for promoting the transfer of heat energy; and said auxiliary magnetic core includes a stack of bent metal sheets having first and second edges which are nipped in the annular groove of said upper torodial cap and the annular grove of said lower torodial cap, respectively.

7. The transformer set forth in claim 6 wherein the annular grooves are open over a portion of their periphery, allowing the metal sheets of the auxiliary magnetic core to be adjusted by peripheral sliding.

8. The transformer set forth in claim 6 wherein:

said auxiliary magnetic core includes at least one annular section and has first and second ends that define an air-gap; and the outer electric winding covers the auxiliary magnetic core, the inner electric winding and only a portion of the air-gap.

9. The transformer set forth in claim 6, wherein:

said outer winding includes first and second winding layers formed by turns of a conductor around said intermediate electric insulating means;

said top and bottom torodial caps of said intermediate electric insulating means each include a plurality of wedges distributed evenly around the outer surfaces of said torodial caps in an intermediate zone between the internal and external contours, each of said wedges having a height substantially equal to the thickness of the conductor used for the outer winding, said wedges being mutually separated by a space of a width greater than the width of the conductor used for the outer winding; and said first winding layer of said outer winding is formed by turns of said conductor each of which is engaged between two successive wedges and said second winding layer of said outer winding is formed by turns of said conductor each passing over a respectively different one of said plurality of wedges.

10. The transformer set forth in claim 6 wherein each of said upper and lower torodial caps includes an inner flange partially covering the inner cylindrical lateral face of the ring formed by said inner electric winding.

11. The transformer set forth in claim 6 wherein each of said upper and lower torodial caps includes an outer flange partially covering the outer cylindrical lateral face of the ring formed by said inner electric winding.

12. The transformer set forth in claim 6 wherein each of said upper and lower torodial caps includes an inner flange and an outer flange partially covering the respective inner and outer cylindrical lateral faces of the ring formed by said inner electric winding.

13. The transformer set forth in claim 6 wherein said upper and lower torodial caps each includes means for holding electrostatic screens in position between the inner electric winding and the outer electric winding.

* * * * *